United States Patent [19]

Hasegawa

[11] 4,219,060

[45] Aug. 26, 1980

[54] METHOD OF AND APPARATUS FOR TENDERIZING VENEER

[75] Inventor: Katsuji Hasegawa, Nagoya, Japan

[73] Assignee: Meinan Machinery Works, Inc., Ohbu, Japan

[21] Appl. No.: 925,638

[22] Filed: Jul. 17, 1978

[51] Int. Cl.[2] ..... B27L 5/02

[52] U.S. Cl. ..... 144/213; 144/323; 144/325; 144/326 R; 144/320 R

[58] Field of Search ..... 144/162 R, 176, 209 R, 144/211, 212, 213, 214, 215, 320, 323, 326 R, 325

[56] References Cited

U.S. PATENT DOCUMENTS

| | | | |
|---|---|---|---|
| 138,901 | 5/1873 | Leslie et al. | 144/213 |
| 435,480 | 9/1890 | Chapman | 144/211 |
| 463,888 | 11/1891 | Chapman | 144/211 |
| 633,548 | 9/1899 | Fenlason | 144/215 |
| 1,641,452 | 9/1927 | Osgood | 144/209 R |
| 2,815,780 | 12/1957 | Higgins | 144/320 |
| 4,061,169 | 12/1977 | Hasegawa | 144/213 |

FOREIGN PATENT DOCUMENTS

| | | | |
|---|---|---|---|
| 605848 | 9/1960 | Canada | 144/213 |
| 64516 | 9/1949 | Netherlands | 144/215 |

*Primary Examiner*—W. Donald Bray
*Attorney, Agent, or Firm*—Lackenbach, Lilling & Siegel

[57] ABSTRACT

A method of and apparatus for tenderizing a veneer. The method has the steps of forming cuts in one of the surfaces of a veneer transferred in a stretched condition, and bending the veneer toward the side opposite to the cut surface, thereby to allow a number of cracks to be generated from the cuts, thereby to tenderize the veneer and to avoid the curling of the same.

18 Claims, 13 Drawing Figures

METHOD OF AND APPARATUS FOR TENDERIZING VENEER

BACKGROUND OF THE INVENTION

The present invention relates to a method of tenderizing veneer sheet (referred to as "veneer," hereinafter) and to an apparatus for carrying out the tenderizing method.

When a veneer is cut off from the material wood, cracks are usually formed in the reverse side of the veneer, i.e. in the machined or parted surface of the latter, so that the length of the veneer grows larger at its reverse side than at its obverse side, resulting in so-called curling.

A conventional measure for avoiding this curling is to mechanically form in the obverse side of the veneer a plurality of cuts corresponding to the cracks, so as to compensate for the difference of length between both sides. This measure is, however, not so effective, because the mechanically formed cuts are refilled shortly after the withdrawal of the cutting blade, due to the elastic resetting nature of the veneer material. The refilled cuts remain in the obverse side of the veneer merely as linear traces of the cutting blade.

Thus, the problem of the curling of veneer remains unsolved.

SUMMARY OF THE INVENTION

It is therefore a major object of the invention to enhance the effect of the tenderizing of veneer, for obtaining a good yield of the products and rationalization of the subsequent steps of process, thereby to improve the efficiency of plywood manufacturing process.

According to the invention, the above stated object is fulfilled by forming a plurality of cuts on one of the surfaces of the veneer and then bending the veneer toward the side opposite to the cut surface, thereby to form a number of cracks.

To this end, the invention provides a method of tenderizing a veneer having the steps of transferring the veneer in the direction substantially perpendicular to the fiber direction of the veneer; forming a plurality of slit-like cuts extending in the fiber direction at a suitable interval or pitch, over the entire length of the veneer, by means of a plurality of edge members; and bending the veneer in the opposite direction to the cut surface, thereby to allow a generation of cracks from the cuts.

According to another aspect of the invention, there is provided a veneer tenderizing apparatus comprising: transfer means adapted to transfer the veneer in the direction substantially perpendicular to the fiber direction of the veneer; edge means opposing to the transfer means at a suitable distance from the latter and adapted to form a plurality of cuts which are spaced in the fiber direction by a suitable pitch; guiding means disposed at the downstream side of the transfer means as viewed in the direction of flow of the veneer; and pressing means disposed at the downstream side of the blade means and adapted to press the veneer against the guide means, so as to bend the veneer in the direction opposite to the cut surface.

BRIEF DESCRIPTION OF THE DRAWINGS

The above and other objects, as well as advantageous features of the invention will become more clear from the following description of the preferred embodiments taken in conjunction with the accompanying drawings in which.

DESCRIPTION OF THE PREFERRED EMBODIMENTS

The invention will be described hereinafter in its preferred forms, with reference to the accompanying drawings.

Figure 1:
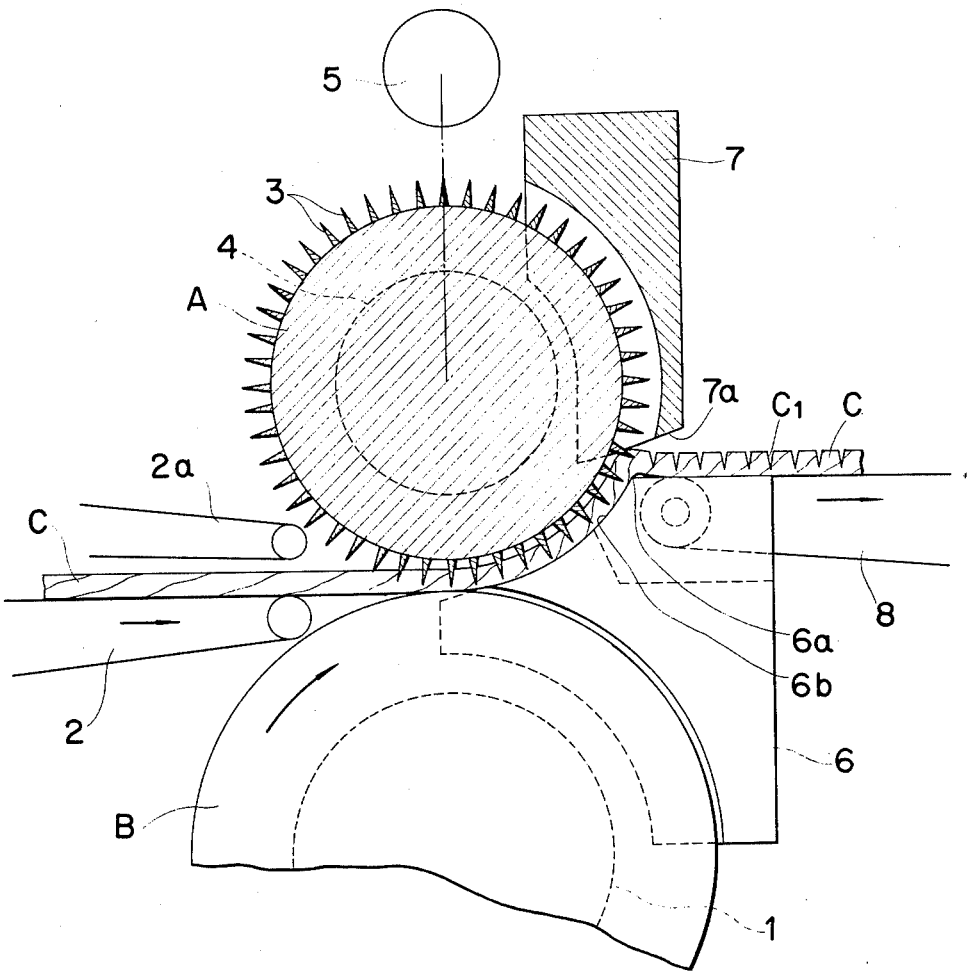
FIG. 1 is a fragmentary side elevational sectional view of an essential part of an embodiment of the invention, illustrating the manner in which a veneer is processed by the method of the invention.
Figure 2:
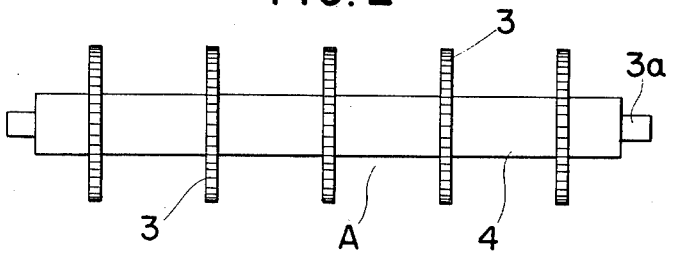
FIGS. 2 and 3 show various modification of a cutting roll as used in the embodiment shown in FIG. 1.
Figure 3:
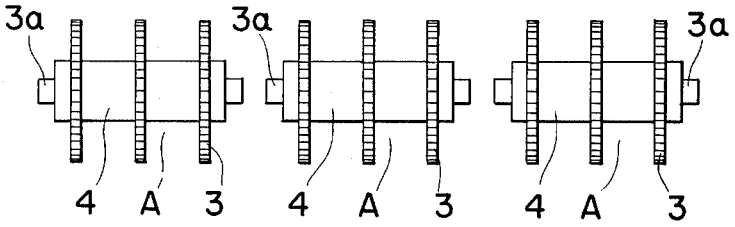

As shown in FIGS. 1 to 3, an apparatus of the invention has a cut-forming roll A carrying at its peripheral surface a plurality of blades or cut-forming edge members 3, an anvil roll B opposing to the cut-forming roll A, driving means for driving the rolls A and B, a guide member 6 for guiding the veneer C in one surface of which cuts $C_1$ have been formed by the cut-forming edge member 3, an abutment member 7 adapted to bend the veneer C and a conveyor 8 as a transfer means.

The roll A is provided on its peripheral surface with a plurality of radially projecting cut-forming edge members 3 which are arrayed at a desired circumferential pitch. The edge members are arranged in a plurality of groups, each of which containing a plurality of edge members spaced in the axial direction at a constant or irregular pitch. At the same time, the roll A has a plurality of recesses 4 adapted to loosely receive the corresponding parts of abutment member 7. Thus, the roll A is made to have a grooved or convexed and concaved peripheral surface between rows of edged members. The concaved portions are constituted by the grooves 4, while the edge members 3 are formed on the convexed portions of the roll A.

The anvil roll B opposing to the cut forming roll A at a suitable distance has a plurality of grooves 1 adapted for loosely receiving the corresponding parts of the guide member 6. The roll B is preferably made of a material which exhibits small elastic deformation such as iron, hard rubber or resin.

Such a distance between the two rolls A and B as would allow the edge members 3 to contact the surface of the roll B is optimum, although the depth of the cut to be formed is determined depending on the condition of the veneer C. Thus, the clearance between the rolls is determined such that the cuts of a suitable depth are formed as the veneer passes through the area between the rolls. This roll distance may be changed and adjusted by suitable adjusting means 5 which will be further described hereinafter.

Figure 4:
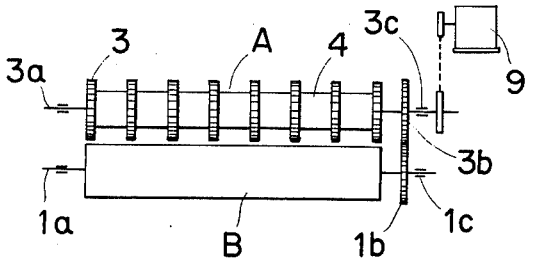
FIG. 4 is a front elevational view of the cutting roll and cooperating anvil roll, in relation with the driving means, as incorporated in the embodiment shown in FIG. 1.

The driving system for either one of these rolls can be an electric motor 9 or the like or, alternativey, both of the rolls are drivin through gears 1*b*, 3*b* mounted on the shafts 1*a*, 3*a* of their respective rollers B and A, as best shown in FIG. 4. Reference numerals 1*c* and 3*c* denote bearings.

The guide member 6 is provided for guiding the veneer C along the delivery-side peripheral surface of the roll A (a circumferential path formed by the successive edge members), so that the veneer C having passed through the gap between the rolls A and B and stabbed with the edge members 3 may not drop off from the edge members.

The guide member 6 is partly received by the grooves 1 of the roll B and have a guide surface 6*b* which includes a curved section extending between a portion in the vicinity of the groove 1 and the abutment member 7, following the curve of the arcuate path of the edge members 3 and a substantially straight section extending away from the surface of the roll A.

The abutment member 7 is adapted to bend the veneer C by a predetermined angle at a portion of the veneer C leaving the edge members 3, in the direction opposite to the surface in which the cuts $C_1$ are formed. The abutment member 7 is partly received by the grooves 4 of the roll A, and is provided with an abutment surface 7*a* which is facing and spaced apart from an apex 6*a* of the guide member 6 by a distance which allows the veneer C to pass therethrough.

The guide member 6 and the abutment member 7 are rigid members secured to the frame (not shown) of the apparatus.

The cut-forming roll A may be constituted by a single rigid roll or, alternatively, by a plurality of axially aligned rolls of a short length supported by respective bearings, as shown in FIG. 3. In the latter case, the assembly must be designed such that the deflection of the cut-forming roll A is considerably diminished. In such a case, the anvil roll B is used as the driving roll, which the cut-forming roll A is used as an idling roll.

In the illustrated embodiment, the bending of the veneer C is effected at a position in the close proximity of the position where the veneer C is pierced and cut. These positions are substantially identical. However, the cutting and the bending may be performed at distant positions from each other. For instance, although not shown in the drawings, a pressing roll and a transfer roll opposing to the pressing roll are disposed at a position sufficiently spaced from the positions where the cutting is performed. The pressing roll is made of a material having a large coefficient of friction, e.g. rubber. An abutment member similar to that of the illustrated embodiment is disposed in association with the pressing roll, while a guide member similar to that of the illustrated embodiment is disposed at the delivery side of the pressing and transfer rolls. These abutment and guide members then cooperate with each other in bending the veneer C in the same manner as the illustrated embodiment. This arrangement is, however, not practical because the cost is raised by the installation of the cut-forming and bending means separate from each other.

Referring again to FIG. 1, feed conveyors 2 and 2*a* are provided for feeding the veneer C into the gap between the cut-forming roll A and the anvil roll B. The upper conveyor 2*a* can be dispensed with, if the insertion of the leading end of the veneer C is made manually, but is necessary when the apparatus of the invention is used in connection with another processing apparatus such as a veneer lathe. A delivery conveyor 8 is disposed at the delivery side of the cut-forming roll A.

The adjusting means 5 is adapted to allow the adjustment of the clearance of two rolls A and B substantially in accordance with the thickness of the veneer, and to impart a force with which the edge members are driven into the body of the veneer C. This adjusting means, which is installed as required, may be constituted by a single screw or a combination of a screw and a pneumatic or hydraulic cylinder or a spring (not shown) arranged to afford the adjustment. Either one of the rolls may be moved toward and away from the other, for the adjustment of the roll clearance.

Figure 5:
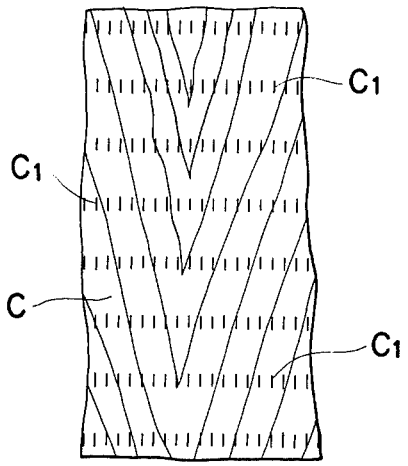
FIG. 5 is a schmetic illustration of a veneer in which slit-like cuts have been formed by an apparatus embodying the invention.
Figure 6:
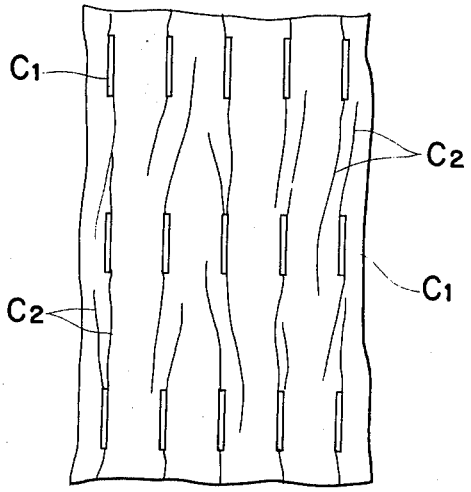
FIG. 6 is a schematic illustration of cracks formed from the cuts on the veneer as shown in FIG. 5, caused by bending the veneer by an apparatus of the invention.

In operation, as the veneer C is fed into the gap between the cut-forming roll A and the anvil roll B such that the direction in which the veneer C is transferred makes substantially a right angle to the fiber direction of the veneer, the veneer C is stabbed with the edge members 3 as it passes through the roll gap. Consequently, as the veneer is continuously fed, a plurality of cuts $C_1$ are formed on the surface of the veneer C confronting the cut-forming roll A, as shown in FIG. 5. The veneer C is conveyed along the guide surface 6*b* of the guide member 6, while it is still stabbed with the blades or edge members 3 even after it has left the anvil roll B. Since the veneer C is forcibly driven by the edge members 3, no clogging can take place. The portion of the veneer C having arrived at the apex 6*b* of the guide member 6 is then pressed by the abutment surface 7*a* of the abutment member 7, so as to change the direction of movement. Namely, the abutment member 7 forcibly disengages the veneer from the edge members 3 and bends the same in the direction opposite to the cut surface such that the surface of the the veneer having the cuts $C_1$ becomes convex while the other surface becomes concave. As a result of this bending, a number of cracks are formed from the cut portions of the veneer C, as will be seen from FIG. 6.

A typical preferred embodiment of the invention has been described with reference to FIGS. 1 to 4. However, this embodiment is not exclusive and the invention can be carried out in various different forms.

Figure 7:
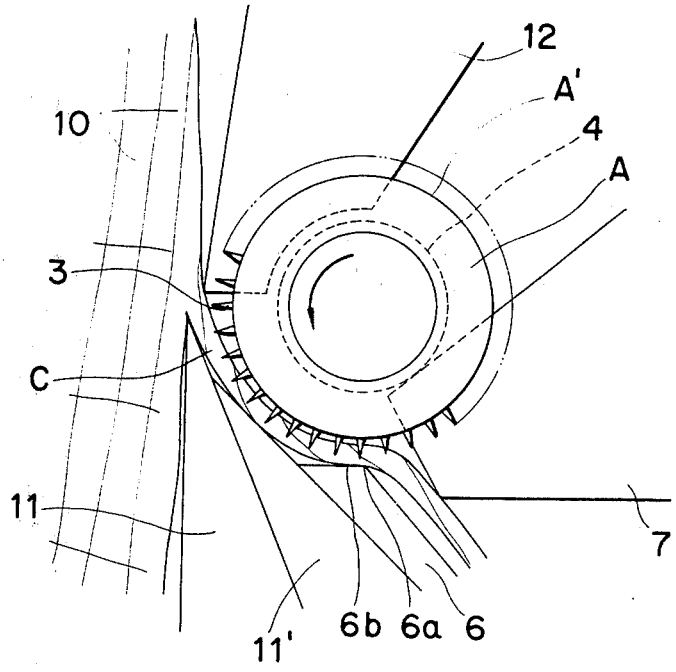
FIG. 7 is a side elevational view of another embodiment of the invention.

Referring now to FIG. 7, the essential part of the invention is used in combination with a veneer lathe. More specifically, the veneer is continuously cut off from a material wood 10 supported and rotated by a chuck (not shown), by means of a peeling knife 11 mounted movably in the direction parallel to the tangential direction of the material wook 10, and is directly fed into the apparatus of the invention. In this embodiment, the shaft A′ of the cut-forming roll A is operatively connected to a driving means (not shown). The axis of the shaft A′ is positioned below the level of the edge of the knife 11, so that the edge members 3 on the roll A may not stab the material work 10, but only the cut off veneer. Suitable speed control means are provided to synchronize the operations of the lathe and the tenderizing apparatus, i.e. to make the circumferential speed of the material wood 10 equal to that of roll A, and roll A is held adjustable toward and away from the separated veneer.

Each of a plurality of grooves 4 receives parts of the abutment member 7 and a nose bar 12 as illustrated. The edge members are mounted radially outwardly on the portions of the enlarged diameter of the roll A, i.e. on the portions of the roll between adjacent grooves 4. A guide member 6 is disposed on a base 11' holding the knife 11, so as to oppose the abutment member 7.

Figure 8:
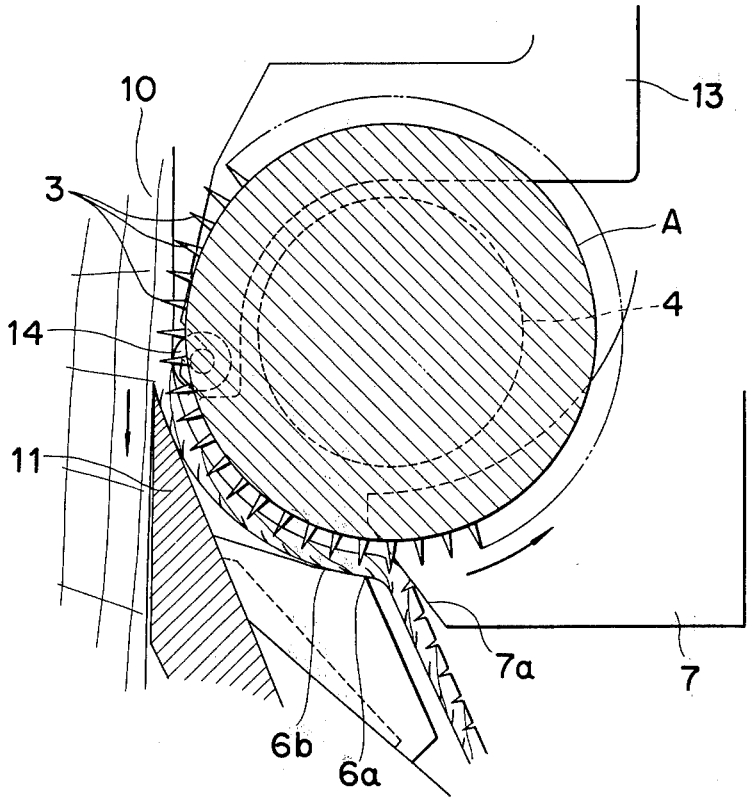
FIGS. 8 and 9 are, respectively, a side elevational view and a front elevational view as viewed from the direction of a material wood, of a still another embodiment of the invention.
Figure 9:
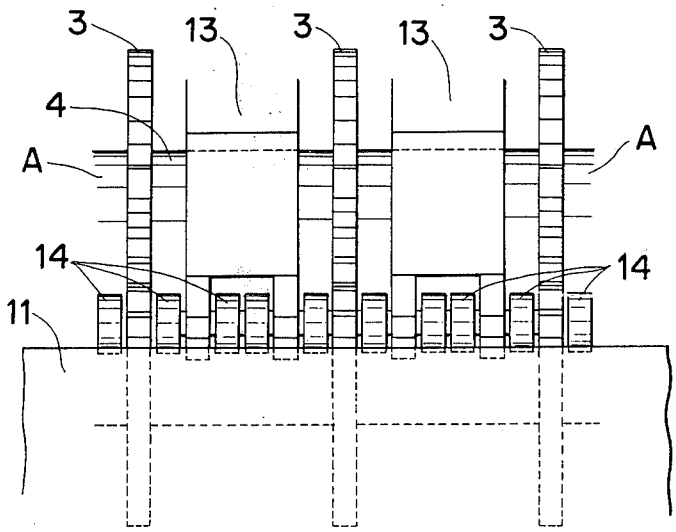
Figure 10:
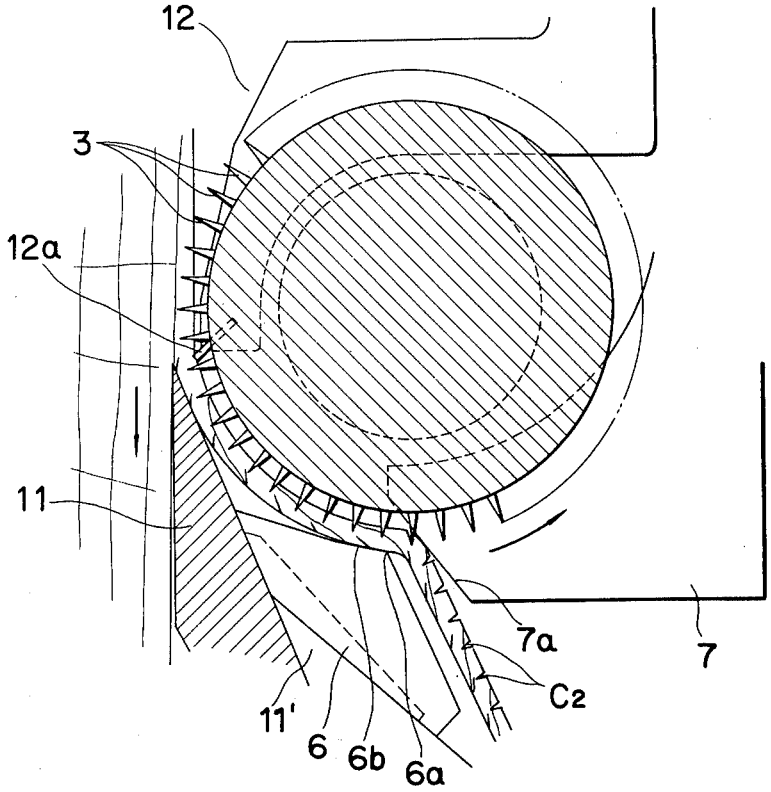
FIGS. 10 and 11 are, respectively, a side elevational view and a front elevational view as viewed from the direction of a material wood, of a further embodiment of the invention.
Figure 11:
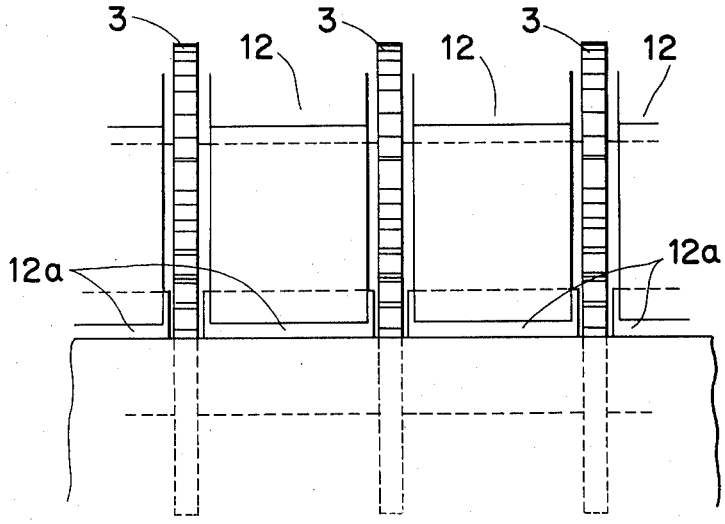

As the chuck starts to rotate, the material wood 10 is rotated and shaved by the knife 11, while being pressed by the nose bar 12. The cut-off veneer is stabbed with the edge members 3 of the roll A, so that a number of cuts are formed on the surface of the veneer. The veneer is then advanced along a part of the circlar path of the roll A, guided by the guide member 6, and is made to change its moving direction. Consequently, the veneer is bent as illustrated, and a number of cracks $C_2$ are formed from the cuts $C_1$.

Where the essential part of the apparatus of the invention is used in combination with a veneer lathe, it is not necessary to drive the roll A as in the described embodiment. FIGS. 8 and 10 show different embodiments in each of which the cut-forming roll A is displaceably mounted such that the edge members 3 on the cut-forming roll A may be driven into the peripheral portion of the material wood 10 which is rotated by the chuck (not shown). Consequently, the roll A is rotated in accordance with the rotation of the material wood 10. The cutting of the material wood, i.e. the separation of the veneer C from the material wood 10 is performed, while the veneer is pressed by a rigid member **12*a* replaceably mounted on a pressure bar 12 or a roller bar 14 carried by a support 13 received by the groove 4**. The veneer thus cut off from the material wood is then processed in the same manner as the foregoing embodiments for the formation of the cracks.

Figure 12:
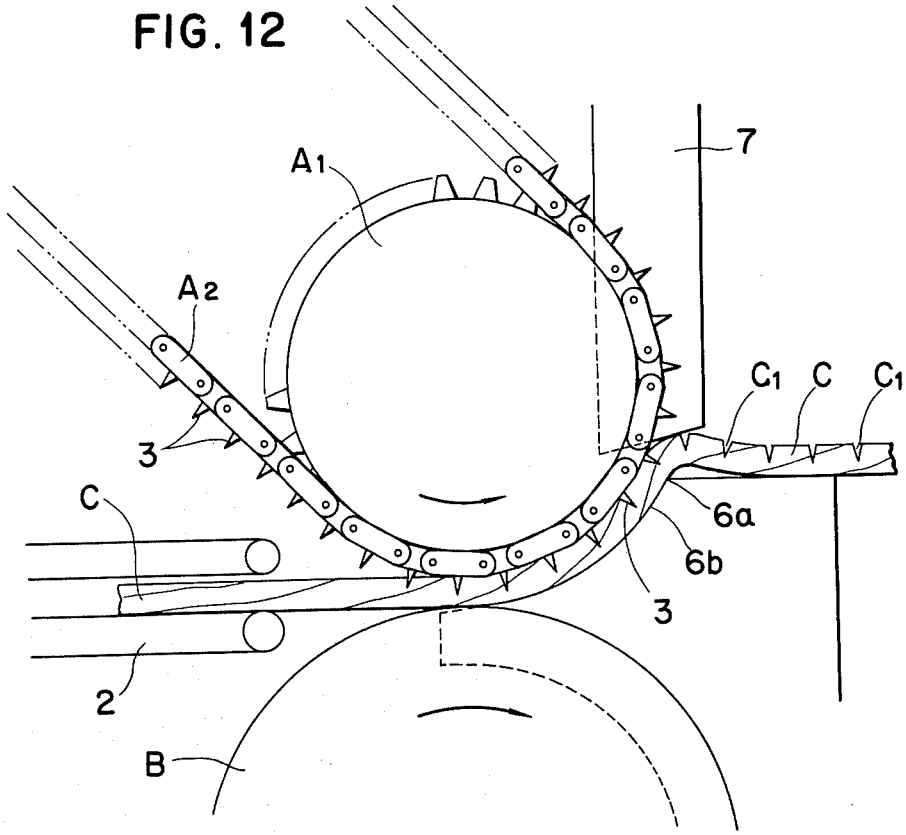
FIG. 12 is a side elevational view of a still further embodiment of the invention.

FIG. 12 shows a further embodiment of the invention in which the cut-forming roll A having peripheral edge members is substituted by a plurality of chains $A_2$ each carrying a plurality of edge members 3. These chains are trained round respective sprocket $A_2$ carried by a common shaft which is driven by a motor (not shown).

Figure 13:
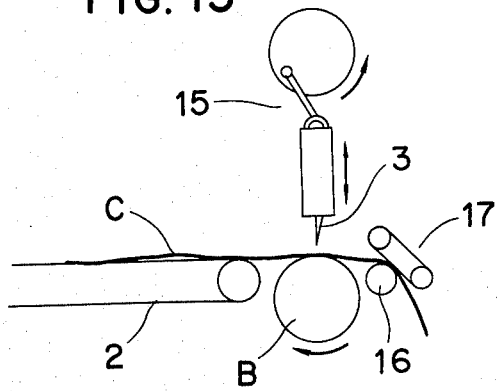
FIG. 13 is a side elevational view of a still further embodiment of the invention.

FIG. 13 shows a still further embodiment in which a number of arrayed edge members 3 are mounted for movement toward and away from the path of veneer, in a reciprocating manner, by a crank mechanism 15. These edge members 3 are intermittently pressed by the crank mechanism 15 against the veneer, so as to form a plurality of cuts $C_2$ on the surface of the veneer.

On the downstream side of the anvil roll B, there is provided a pressing conveyor 17 adapted to press the veneer C against a support 16, so as to bend the veneer C. This embodiment functions in the same manner as the other described embodiment.

As has been described, according to the invention, the veneer having a number of cuts is bent in the direction opposite to the cut surface, so that a number of cracks $C_2$ are formed on that surface from the grooves. These cracks are not continuous but exist independently. Most of these cracks are omnidirectional and penetrate the veneer to substantial depth, thereby to provide a considerable tenderizing effect.

The critical feature does not exist in a mere cutting nor mere bending, but in bending the veneer after forming the cuts on the veneer surface. Provided that the veneer is forcibly bent without the cutting step, the cracks will extend linearly in the fiber direction to cause the veneer to be completely split or torn. According to the invention, on the other hand, the cracks grow omnidirectionally, so that no linear continuity of the cracks in the fiber direction is formed, thus ensuring a good tenderizing effect.

In addition, the clogging of rolls, which tends to occur when the veneer is bent at an extremely large angle, for example to form a inversed V-shape, is avoided because the veneer is forcibly forwarded by the edge members to the bending section, so ensuring a smooth continuous operation of the apparatus.

Further, since the bending action is not caused by elastic material but, rather by a rigid material, the cracks are definitely formed and distributed uniformly.

Moreover, since the curling caused in the separation of the veneer from the material wood is corrected to flatten the veneer, the delivery or insertion of the veneer to the subsequent processing device such as chopping device is considerably improved. At the same time, the jointing of veneers in the next jointing step is conducted without being accompanied by undesirable peeling off of the jointing threads or tapes, due to the flattened condition of the veneer. Also, the drying efficiency is much improved since the heat transfer into the body of the veneer, as well as the evaporation of the water content, is enhanced by the presence of the cracks.

The processing by the method of the invention also provides for the effective elimination of internal stress of the veneer. Consequently, strain or distortion of the plywood, as well as other problems attributable to the internal stress, is avoided. At the same time, the veneer can be manhandled, because the veneer produced by the method of the invention has been tenderized without being accompanied by local stress concentration. Further, the entanglement of the fibers in the veneer is avoided due to the presence of the large number of cracks therein. In addition, it becomes possible to stretch a veneer in the direction perpendicular to the fiber direction, thereby improving the yield.

It will be seen from the foregoing description that the aforementioned problems of the prior art are overcome by the method and apparatus of the invention. In addition, the invention provides an apparatus having a simple construction and reasonable arrangement which remarkably enhances the tenderizing effect. The invention affords a mass production of plywood product at low cost, and greatly contributes to the improvement and efficiency of production in the plywood industry, as well as to a more efficient use of the wood resources.

What is claimed is:

1. A method of tenderizing veneer comprising the steps of:

feeding along a plane a veneer sheet cut off from a log in a direction substantially perpendicular to the fiber direction of said veneer sheet;

forming a plurality of cuts on one side of said veneer sheet, each cut having a straight bottom line substantially parallel to the fiber direction of the veneer sheet;

bending the fed veneer sheet by means of a fixed abutment member in a direction opposite the cut side to bend the veneer sheet about a guide member such that a ridge formed by the bent veneer sheet runs parallel to said straight bottom line, so as to form therein in a controlled manner the formation of a plurality of cracks from the number of cuts formed, thereby tenderizing said veneer and precluding the curling thereof.

2. A method as claimed in claim 1, wherein the step of forming a plurality of cuts includes the step of bringing plural rows of outwardly radially extending edge members into piercing engagement with one side of said veneer sheet.

3. A method as claimed in claim 1, wherein the step of forming a plurality of cuts includes the step of reciprocating a plurality of edge members into and out of piercing engagement with said veneer sheet.

4. A method of tenderizing veneer comprising the steps of:

forming a plurality of cuts using a roller with piercing means on one side of a veneer which is cut-off the periphery of a log being turned on a veneer lathe, each of said cuts having a straight bottom line substantially parallel to the fiber direction of said veneer;

bending said veneer by means of a fixed abutment member in a direction opposite the cut side of said veneer to bend said veneer about a guide member such that a ridge formed by the bent veneer sheet runs parallel to said straight bottom line, so as to form therein in a controlled manner the formation of a plurality of cracks from the number of said cuts formed in said veneer, thereby tenderizing the veneer and precluding the curling thereof.

5. A method of tenderizing veneer according to claim 4, wherein the step of forming a plurality of cuts is performed on said veneer below the point where the veneer is cut from the periphery of said log.

6. A method of tenderizing veneer according to claim 4, wherein the circumferential speed of the log is equal to the speed of said roller having piercing means.

7. A method according to claim 4, wherein the step of forming a plurality of cuts using piercing means includes the step of bringing plural rows of outwardly radially extending edge members into piercing engagement with one side of said veneer.

8. An apparatus for tenderizing a veneer comprising: a veneer lathe adapted to turn a log; a knife movably mounted in a direction substantially parallel with the tangential direction of said log for cutting a veneer from said log; a roll movably provided relative to the veneer lathe and carrying a plurality of rows of edge members projecting radially outwardly therefrom, and said roll being formed with groove means, between said rows; a guid means mounted on said knife and received in each groove, and adapted to guide the veneer separated from said log by the knife, and means received in each groove on the downstream side of said guide means in an opposing relation thereto and adapted to disengage said veneer from said edge members of said roll and bend said veneer in a direction opposite to the cut side thereof.

9. An apparatus according to claim 8, wherein said roll is an idle roller.

10. An apparatus according to claim 8, wherein said roll is a drive roller.

11. An apparatus according to claim 8, including pressing means received in the groove for pressing the log ahead of the edge of said knife.

12. An apparatus according to claim 11, wherein said pressing means also includes a nose bar.

13. An apparatus according to claim 11, wherein said pressing means is a roller bar mounted on a support.

14. An apparatus for tenderizing veneer comprising: a driving anvil roll adapted to move or feed a veneer sheet in a direction substantially perpendicular to the fiber direction of the veneer; cutter means disposed opposite said anvil roll at a predetermined distance therefrom and being adapted to form a plurality of cuts; each cut having a straight bottom line extending substantially parallel to the fiber direction of said veneer sheet, and being formed on one side of said veneer sheet; and guide means adapted to guide said veneer sheet in a direction opposite the cut side to bend the veneer sheet such that a ridge formed by the bent veneer sheet runs parallel to said straight bottom line of the cut.

15. An apparatus according to claim 14, wherein said cutter means includes a least one roll supported rotatably and a plurality of rows of radial blade means mounted thereon each having a plurality of circumferentially spaced edge members projecting radially from the roll, each radial blade means being spaced in the axial direction from adjacent ones, and said roll being formed with a groove between each two adjacent rows for receiving said guide means.

16. An apparatus according to claim 15, wherein said blade means is carried by a common shaft, and said roll is a drive roller.

17. An apparatus according to claim 15, wherein said cutter means include a plurality of driving sprockets carried by a common shaft extending substantially in parallel with the fiber direction of the veneer, an endless chain trained over each sprocket and a plurality of edge members secured to the outside of said chain at predetermined distances from each other.

18. An apparatus according to claim 14, wherein said cutter means include a plurality of edge members arrayed in at least one row extending in the fiber direction of the veneer, and the edge members being adapted to be moved in a reciprocating manner toward and away from the beneer by a common crank mechanism.

* * * * *